United States Patent [19]

Cruchon et al.

[11] Patent Number: 4,961,061

[45] Date of Patent: Oct. 2, 1990

[54] PHASE-SHIFTING COMBINER FOR ELECTROMAGNETIC WAVES

[75] Inventors: Jean-Claude Cruchon, Bouffemont; Gilbert Prost, Cergy Saint Christophe, both of France

[73] Assignee: Alcatel N.V., Amsterdam, Netherlands

[21] Appl. No.: 333,341

[22] Filed: Apr. 4, 1989

[30] Foreign Application Priority Data

Apr. 6, 1988 [FR] France ..... 88 04542

[51] Int. Cl.[5] ..... H01P 1/18; H01P 5/00

[52] U.S. Cl. ..... 333/156; 333/109; 333/117

[58] Field of Search ..... 333/156, 160, 109–111, 333/117–120, 121, 123, 136, 126

[56] References Cited

U.S. PATENT DOCUMENTS

| | | | |
|---|---|---|---|
| 2,531,447 | 11/1950 | Lewis | 333/135 |
| 2,633,492 | 3/1953 | Ring | 333/120 |
| 2,639,326 | 5/1953 | Ring | 333/28 R |
| 2,888,651 | 5/1959 | Brandon | 333/159 |
| 3,049,679 | 8/1962 | Proctor, Jr. | 333/113 |
| 3,727,152 | 4/1973 | Bodonyi | 333/135 |
| 3,967,220 | 6/1976 | Tagashira | 333/109 |
| 3,967,223 | 6/1976 | McAvoy | 333/219 |
| 4,602,227 | 7/1986 | Clark | 333/109 |

FOREIGN PATENT DOCUMENTS 0851888 6/1958 United Kingdom .

OTHER PUBLICATIONS

Revue Technique C.F.T.H., Thompson CFTH Houston Electronics, 1955, pp. 63–78, Compagnie Francaise Thompson-Houston—Groupe Electronique—173, BD Haussmann, Paris-8.

IEEE Transactions on Microwave Theory and Techniques, vol. MTT-31, 2/2/83, pp. 91–107, IEEE, New York, K. Chang et al., "Millimeter-Wave Power-Comvining Techniques", p. 98, Paragraph III B, FIG. 21.

Matthaei, *Microwave filters, impedance matching, networks and coupling structures,* McGraw-Hill, 1964, pp. 872–887.

*Primary Examiner*—Eugene R. Laroche
*Assistant Examiner*—Seurg Ham
*Attorney, Agent, or Firm*—Christie, Parker & Hale

[57] ABSTRACT

The invention relates to a phase-shifting combiner for electromagnetic waves, the combiner comprising at least one phase-shifting cell constituted by a hybrid coupler (12), an inlet transmission line (10), an outlet transmission line (11), and a loop transmission line (13) connected between the first inlet and the first outlet of the coupler (12), the inlet transmission line (10) being connected to the second inlet of the coupler and the outlet transmission line (11) being connected to the second outlet of the coupler. It is applicable, in particular, to telecommunications.

6 Claims, 5 Drawing Sheets

PHASE-SHIFTING COMBINER FOR ELECTROMAGNETIC WAVES

The present invention relates to a phase-shifting combiner for electromagnetic waves.

BACKGROUND OF THE INVENTION

In prior art phase-shifting combiners, the phase shifters are constituted by lengths of transmission line or by a hybrid coupler having two access ports provided with short-circuited transmission lines.

Applications have remained very limited because of the losses or the mismatches to which they give rise.

Applications currently in use include the following:

two or four phase state modulators;

phase shifting combiners; and waveguides having variable permeability or permitivity.

In the prior art, the manual entitled "Microwave filters, impedance matching, networks and coupling structures" by Matthaei (McGraw-Hill, 1964) pp. 872 to 887 describes a ring resonator which is a passive power multiplying device.

The object of the invention is to mitigate the drawbacks outlined above.

SUMMARY OF THE INVENTION

To this end, the present invention provides a phase-shifting combiner for electromagnetic waves, the combiner comprising at least one phase-shifting cell constituted by a hybrid coupler, an inlet transmission line, an outlet transmission line, and a loop transmission line connected between the first inlet and the first outlet of the coupler, the inlet transmission line being connected to the second inlet of the coupler and the outlet transmission line being connected to the second outlet of the coupler, wherein the combiner comprises at least one loop combiner cell constituted by an inlet hybrid coupler and an outlet hybrid coupler, at least one phase-shifting cell being disposed respectively between the first outlet of the inlet coupler and the first inlet of the outlet coupler and between the second outlet of the inlet coupler and the second inlet of the outlet coupler.

Advantageously, the theory of a phase-shifting combiner in accordance with the invention is simple and easy to implement.

It possesses the property of being suitable for association in series or in parallel, providing the phase conditions of the functions to be obtained are satisfied.

In addition, it is tunable (frequency agility) by changing the permitivity or the permeability of its (propagation) medium.

As a function of the selected propagation mode, the invention provides a low-loss combiner which adds little or no SWR (standing wave ratio) on the transmission lines so long as the lengths and loop impedances are optimized and the coupling is tuned.

These various advantages provide, in particular:

a matched phase shifter;

a reversible combiner (single or multiple); and a matched switch.

BRIEF DESCRIPTION OF THE DRAWINGS

Embodiments of the invention are described by way of example with reference to the accompanying drawings, in which.

DETAILED DESCRIPTION

Figure 1:
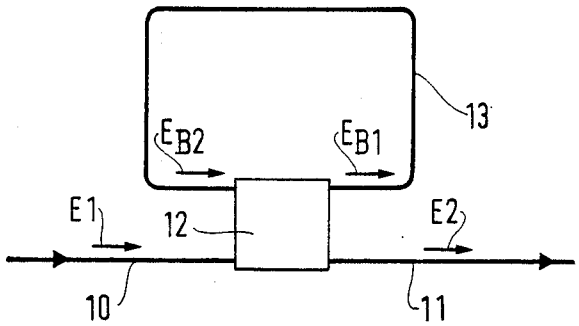
FIG. 1 is a diagram of a phase shifter used in a phase-shifting combiner of the invention.
Figure 2:
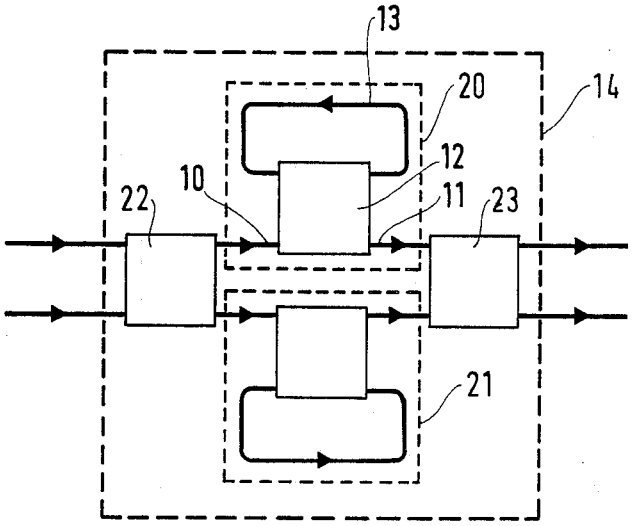
FIGS. 2 to 8 show various different embodiments of a phase-shifting combiner in accordance with the invention.

The phase-shifting combiner of the invention as shown in FIG. 2 possesses at least one phase shifter as shown in FIG. 1, said phase shifter comprising:

an inlet first transmission line 10 having characteristic impedance Zo at a frequency f;

an outlet second transmission line 11 having characteristic impedance Zo at the frequency f;

a hybrid coupler 12; and a loop third transmission line 13 having characteristic impedance Zo at the frequency f.

The electrical fields at the origin can be written:

$$E1=1 \text{ (with a phase}=0);$$

$$E2=\sqrt{(1-c^2)} \text{ (with a phase}=0);$$

$$EB1=c \text{ (with a phase}\pi/2);$$

$$EB2=ce^{-(\alpha+j\beta)l} \text{ (with a phase } \beta l=2\pi l/\lambda \text{ and } \pi/2)$$

where c=voltage coupling coefficient;

l=length of the Zo impedance loop;

$\alpha$=attenuation coefficient;

$\beta$=propagation coefficient; and $\lambda$=wavelength with $\lambda=C/f$ (C=speed of light, f=operating frequency).

If the following simplifications are assumed:

$\alpha=0$ for lines having zero loss (or very low loss); and $\beta l = n.2.\pi \rightarrow l=n\lambda$.

Under steady conditions:

$$E2=\sqrt{(1-c^2)}+c.EB2$$

where $$EB2=c/[1-\sqrt{(1-c^2)}] \text{ (with a phase of } \pi/2)$$

and which, incorporated in E2, gives the following equation:

$$E2=\sqrt{(1-c^2)}-c^2/[1-\sqrt{(1-c^2)}]$$

When the coupling coefficient is −3 dB $$c=10^{-(3/20)}\approx 0.71$$

which gives the following expression for E2

$$E2=-1\rightarrow E2=E1.e^{j\pi}$$

After passing through a loop phase shifter of the invention, the wave E1 is subjected to a phase shift of $\pi$ (180°) when the length (l) of the resonant line (loop) is a multiple of $\lambda$ (n=1, 2, . . . , etc.).

The circuit of the invention is applicable to the following fields:

It can be used in any propagation structure for implementing hybrid couplers or T couplers associated with transmission lines.

It can be used with any type of electromagnetic wave, e.g. HF (high frequency); VHF (very high frequency); UHF (ultra-high frequency); or coherent optics.

It can be used with any electromagnetic wave propagation medium (transmission lines), e.g. coaxial cable, microstrip, three-layer plate, waveguide, optical fiber, . . . .

In the various embodiments described, it is assumed:

either that n is low, with c equal to −3 dB or otherwise, in which case an arbitrary non-selective phase shifter is obtained;

or else n is high with c equal to −3 dB, or otherwise, in which case a selective phase shifter is obtained.

In order to tune a phase shifter in accordance with the invention, the relative permitivity $\epsilon r$ or the relative permeability $\mu r$ of the propagation medium can be adjusted: an electromagnetic wave propagates at a speed of $$v=\sqrt{(\epsilon.\mu)}$$

where $$\epsilon=\epsilon o.\epsilon r\epsilon o=\lambda\sqrt{/(36.\pi.10^9)}$$

and $$\mu=\mu o.\mu r\ \mu o=4.\pi.10^{-7}$$

For the time being consider microwave frequencies, in which case given the expression for phase, two hybrid couplers in cascade make it possible at the outlet to recombine a wave on an opposing port (wave cancellation at the second outlet).

An equivalent principle shows up recombinations using "magic-Ts".

By using loop phase shifters of the invention it is possible to act on the phase of one or both inlets of a system while retaining the desired properties, i.e.:

low transmission loss;

good SWR at the ports; and good decoupling between ports.

Thus, for small n, a microwave switch can be made, as shown in FIG. 2, by taking two phase shifters of the invention 20 and 21 whose inlets are connected to the outlets of a first hybrid coupler 22 and whose outlets are connected to the inlets of a second hybrid coupler 23.

By inserting a phase shifter (20, 21) on each of the connections between the two hybrid couplers 22 and 23, two state phase variation is obtained with a passband which is widened by the shifting of the two phase shifters 20 and 21.

The states at the outlets are determined by action on the permitivity $\epsilon r$ or the permeability $\mu r$ of the medium.

Figure 3:
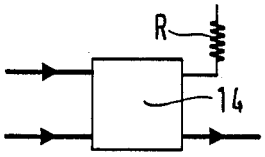
Figure 4:
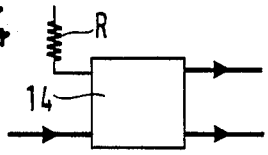

In order to make a loop combiner with a high value of n, one such phase shifter 14 is used, as shown in FIGS. 3 and 4, in which one of its two inlets or one of its two outlets is connected to a matched termination R.

The function looked for in this case is selectivity (application to branching).

Depending on how it is defined, it is possible either to obtain summing (two inlets-one outlet) or else splitting (one inlet-two outlets).

In this case, varying the permeability $\mu r$ or the permitivity $\epsilon r$ of the medium displaces the frequency of the phase shifted port, and thus makes it tunable (i.e. provides agility).

Figure 5:
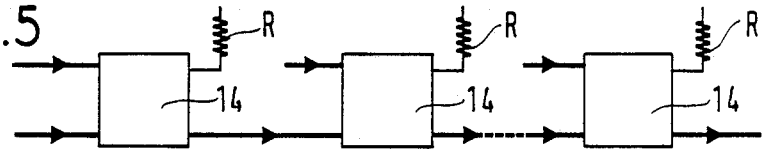

By putting n cells in cascade, as shown in FIG. 3 for example, it is possible to obtain an n+1 inlet multiplexer as shown in FIG. 5 which, by application of the reciprocity theorem applicable to any passive component, therefore also constitutes a n+1 outlet demultiplexer.

Any other disposition with loop interpenetration may also be considered.

Figure 6:
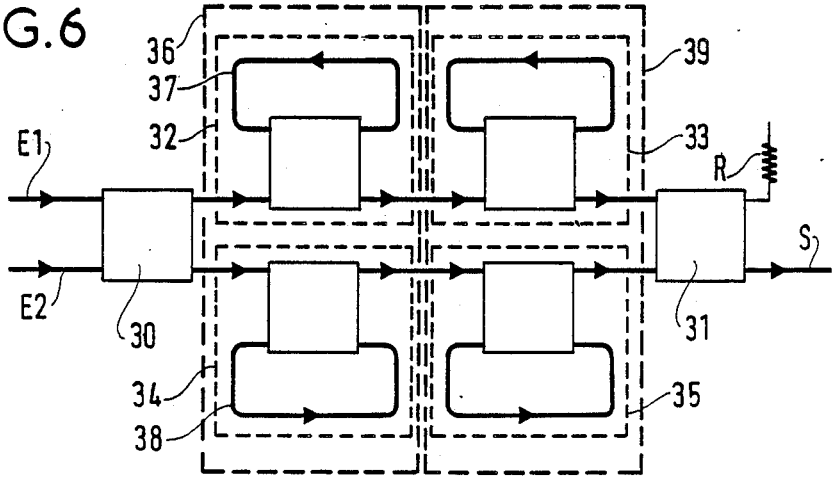

In an embodiment as shown in FIG. 6, a two loop combiner is obtained having two inlets and one outlet such that the combiner comprises an inlet hybrid coupler 30 and an outlet hybrid coupler 31 with two phase shifters of the invention (32, 33 and 34, 35) being disposed in cascade respectively between the first outlet of the inlet coupler 30 and the first inlet of the outlet coupler 31, and between the second outlet of the inlet coupler 30 and the second inlet of the outlet coupler 31.

Figure 7:
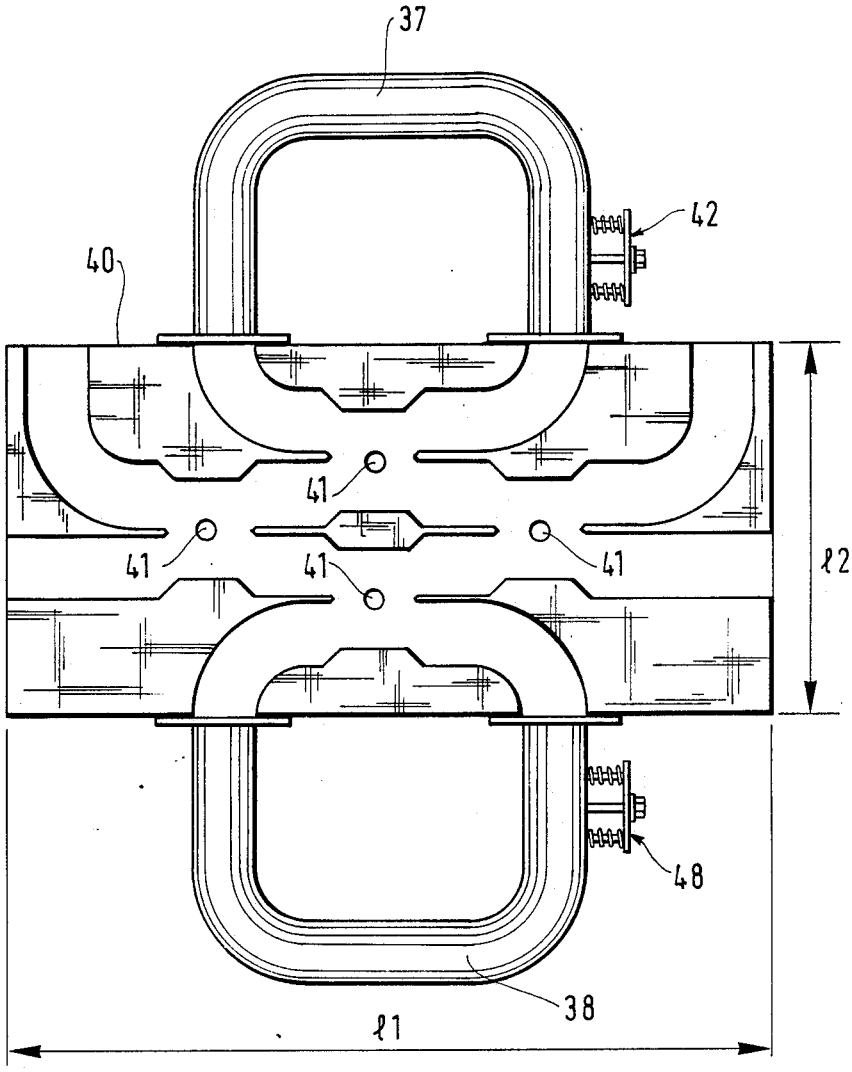

The set 36 of the two phase shifters 32 and 34 may be provided in a common housing as shown in FIG. 7 and comprising:

two metal half-shells obtained by machining and provided on the outside with a radiator (one of which, 40, is visible in the figure);

a first loop 37 made of INVAR; and a second loop 38 also made of INVAR.

The two half-shells are assembled in the plane of the figure by silkscreen deposition of solder paste.

The half-shell 40 shown includes projections 41 which correspond to tuning screws in the other half-shell. Each of the loops 37 and 38 includes a tuning quartz blade 42 or 48.

The two loops are made of INVAR in order to ensure temperature stability.

Figure 8:
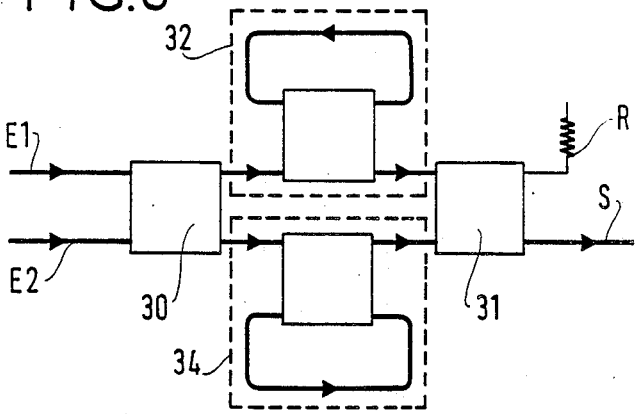

For a housing having the following dimensions:

length of housing 11≈500 millimeters;

length of housing 12≈250 millimeters;

length of first loop 37≈400 millimeters; and length of second loop 38≈390 millimeters;

the following performance is obtained for the two inlet and one outlet two loop combiner shown in FIG. 8:

frequency band 5.85 GHz to 6.425 GHz;

SWR at ports <1.2;

loss between first inlet E1 and outlet S <0.2 dB over ±18 MHz;

losses between second inlet E2 and outlet S <0.2 dB; and decoupling between inlets E1 and E2 >20 dB.

Figure 9:
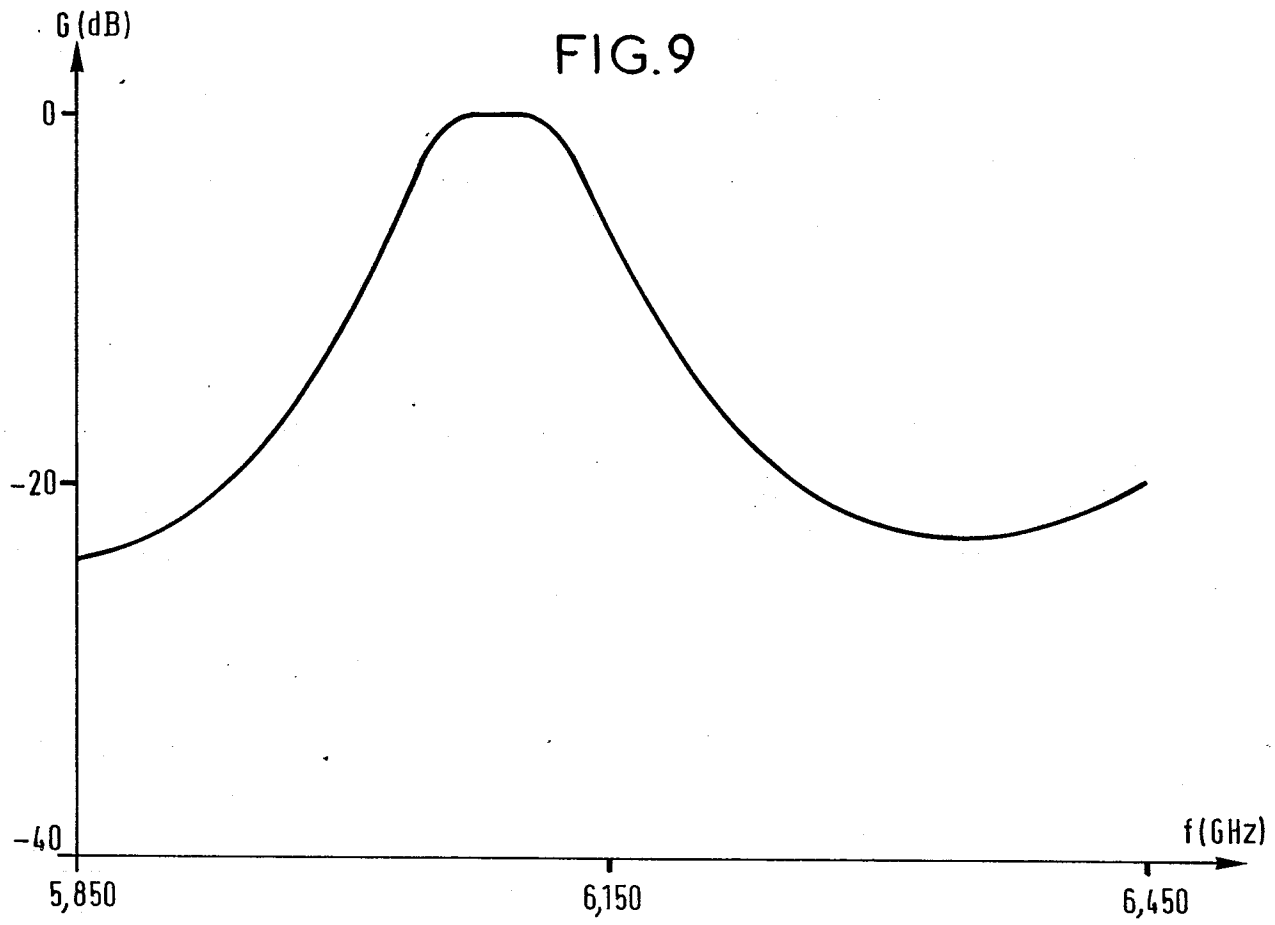
FIGS. 9 and 10 are two graphs showing the operation of the combiners of FIGS. 6 and 8, respectively.

The curve shown in FIG. 9 shows the effect of the recombination of the second inlet E2 to the outlet S.

It would be just as possible to make the two parts 36 and 39 together and indeed the entire two loop combiner shown in FIG. 6 in a single housing having two half-shells like that shown in FIG. 7.

Another possible embodiment is shown in FIG. 8 which differs from FIG. 6 by using only one phase shifter (32, 34) of the invention in each path.

Figure 10:
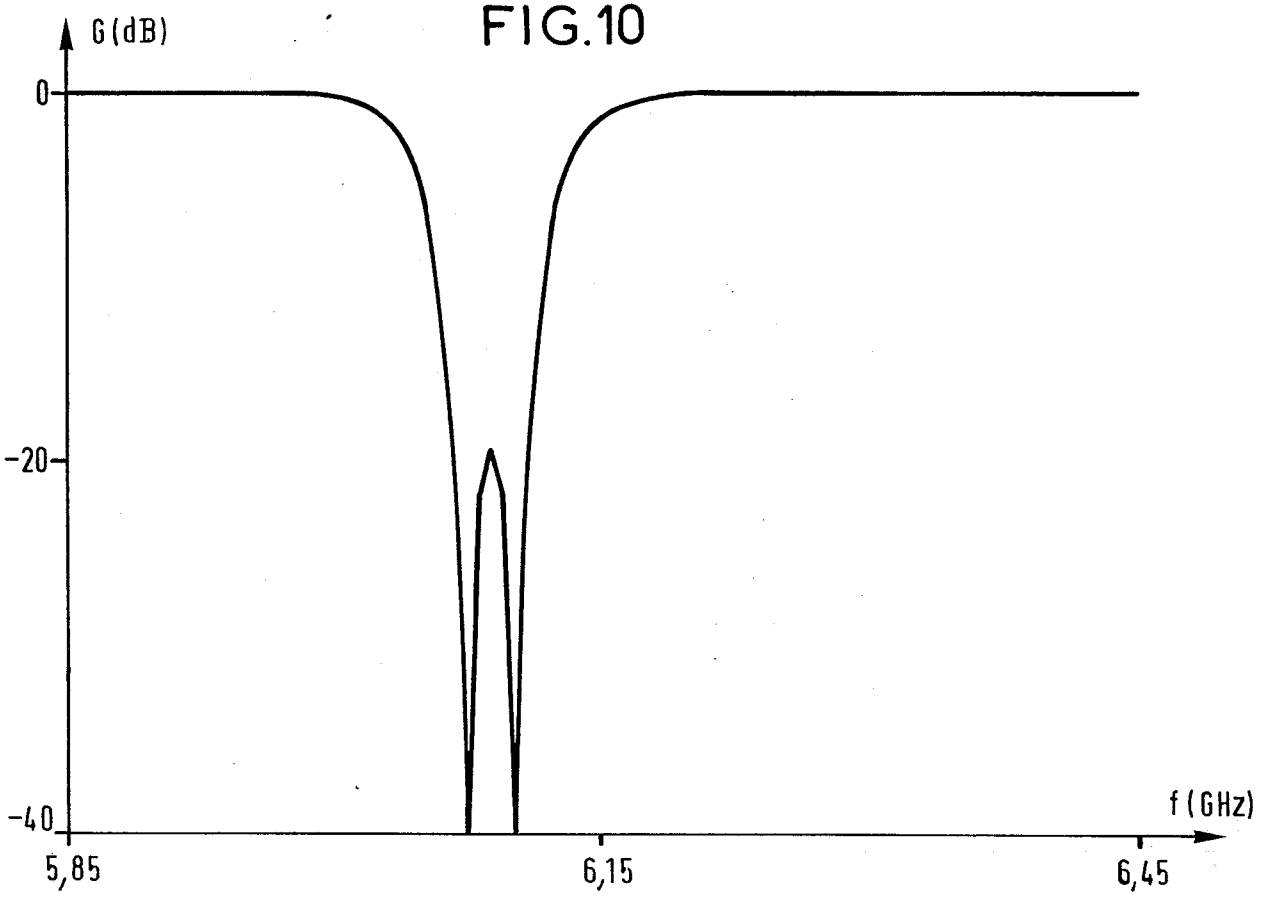

The signal shown in FIG. 10 is then obtained which shows the effect of the recombination of the first inlet E1 to the outlet S.

Naturally the present invention has been described and shown merely by way of preferred example and its component parts could be replaced by equivalent parts without thereby going beyond the scope of the invention.

We claim:

1. A phase-shifting combiner for electromagnetic waves, the combiner comprising at least one loop combiner cell further comprising an inlet hybrid coupler, an outlet hybrid coupler, a first phase-shifting cell disposed between the first outlet of the inlet hybrid coupler and the first inlet of the outlet hybrid coupler, and a second phase-shifting cell disposed between the second outlet of the inlet coupler and the second inlet of the outlet coupler, wherein each said phase-shifting cell further comprises a loop hybrid coupler, an inlet transmission line having a predetermined characteristic impedance and connected to the second inlet of the loop hybrid coupler, an outlet transmission line also having said predetermined characteristic impedance and connected to the second outlet of the loop hybrid coupler, a loop transmission line also having said predetermined characteristic impedance and connected between the first inlet and the first outlet of the loop hybrid coupler.

2. A combiner according to claim 1, wherein a first inlet of the inlet hybrid coupler is connected to a matched load.

3. A combiner according to claim 1, comprising a plurality of said loop combiner cells disposed in cascade.

4. A combiner according to claim 1, wherein a first outlet of the outlet hybrid coupler is connected to a matched load.

5. A combiner according to claim 1 wherein the two said phase shifting cells are provided in a common housing comprising two metal half-shells to which two external loops are attached.

6. A combiner according to claim 5, wherein the two half-shells are assembled together by silkscreen deposition of a solder paste, with the two loops being made of INVAR.

* * * * *